US006536540B2

(12) United States Patent
de Boer

(10) Patent No.: US 6,536,540 B2
(45) Date of Patent: Mar. 25, 2003

(54) METHOD AND APPARATUS FOR VARYING THE DENSITY OF DRILLING FLUIDS IN DEEP WATER OIL DRILLING APPLICATIONS

(76) Inventor: Luc de Boer, 8585 Woodway, Apt. 1112, Houston, TX (US) 77063

( * ) Notice: Subject to any disclaimer, the term of this patent is extended or adjusted under 35 U.S.C. 154(b) by 23 days.

(21) Appl. No.: 09/784,367

(22) Filed: Feb. 15, 2001

(65) Prior Publication Data

US 2002/0108782 A1 Aug. 15, 2002

(51) Int. Cl.[7] ..... C09K 7/08

(52) U.S. Cl. ..... 175/70; 175/7; 175/66; 175/71; 175/217

(58) Field of Search ..... 166/358; 175/5, 175/7, 8, 65, 66, 69–71, 206, 217

(56) References Cited

U.S. PATENT DOCUMENTS

| | | | | |
|---|---|---|---|---|
| 3,603,409 A | * | 9/1971 | Watkins | 175/7 |
| 4,099,583 A | * | 7/1978 | Maus | 175/7 |
| 4,291,772 A | * | 9/1981 | Beynet | 175/5 |
| 5,873,420 A | | 2/1999 | Gearhart | |
| 6,152,246 A | | 11/2000 | King et al. | |
| 6,179,071 B1 | | 1/2001 | Dietzen | |

OTHER PUBLICATIONS

IADC/SPE 1996 Drilling Conference Abstract Reporting Form/1 page, Mar. 1996.

* cited by examiner

*Primary Examiner*—David Bagnell
*Assistant Examiner*—Zakiya Walker
(74) *Attorney, Agent, or Firm*—Robert C. Curfiss

(57) ABSTRACT

A method and apparatus for controlling drilling mud density at or near the seabed of wells in deep water and ultra deep-water applications combines a base fluid of lesser density than the mud required at the wellhead to produce a diluted mud in the riser. By combining the appropriate quantities of drilling mud with base fluid, a riser mud density at or near the density of seawater may be achieved. No additional hardware is required below the surface. The riser charging lines are used to inject the low-density base fluid at or near the BOP stack on the seabed. The cuttings are brought to the surface with the diluted mud and separated in the usual manner. The diluted mud is then passed through a centrifuge system to separate the heavier drilling mud from the lighter base fluid.

19 Claims, 3 Drawing Sheets

METHOD AND APPARATUS FOR VARYING THE DENSITY OF DRILLING FLUIDS IN DEEP WATER OIL DRILLING APPLICATIONS

BACKGROUND OF INVENTION

1. Field of Invention

The subject invention is generally related to systems for delivering drilling fluids (mud) for oil and gas drilling applications and is specifically directed to a method and apparatus for varying the density of mud in deep water oil and gas drilling applications.

2. Description of the Prior Art

It is well known to use drilling mud to drive drill bits, maintain hydrostatic pressure and to carry away particulate matter when drilling for oil and gas in subterranean wells. Basically, the drilling mud is pumped down the drill pipe and provides the fluid driving force for the drill bits, and then it flows back up from the bit along the periphery of the drill pipe and inside the open hole and casing for removing the particles loosed by the drill bit. At surface the returning mud is cleaned to remove the particles and recycled down into the hole.

The density of the drilling mud is monitored and controlled in order to maximize the efficiency of the drilling operation and to maintain the hydrostatic pressure. In a typical application, a well is drilled using a drill bit mounted on the end of a drill stem inserted down the drill pipe. The mud is pumped down the drill pipe and through the drill bit to drive the bit. A gas flow is also pumped and/or other additives are also pumped into the drill pipe to control the density of the mud. The mud passes through the drill bit and flows upwardly along the drill string inside the open hole and casing, carrying the loosed particles to the surface.

One example of such a system is shown and described in U.S. Pat. No. 5,873,420, entitled: "Air and Mud Control System for Underbalanced Drilling", issued on Feb. 23, 1999 to Marvin Gearhart. The system shown and describe in the Gearhart patent provides for a gas flow in the tubing for mixing the gas with the mud in a desired ration so tat the mud density is reduced to permit enhanced drilling rates by maintaining the well in an underbalanced condition.

It is known that there is a preexistent pressure on the formations of the earth, which, in general, increases as a function of depth due to the weight of the overburden on particular strata. This weight increases with depth so the prevailing or quiescent bottom hole pressure is increased in a generally linear curve with respect to depth. As the well depth is doubled, the pressure is likewise doubled. When drilling in deep water or ultra deep water this is further complicated because of the pressure on the sea floor by the water above it. Thus, high-pressure conditions exist at the beginning of the hole and increase as the well is drilled. It is important to maintain a balance between the mud density and pressure and the hole pressure. Otherwise, the pressure in the hole will force material back into the well bore and cause what is commonly known as a blowout. In basic terms, the gases in the well bore flow out of the formation into the well bore and bubble upward. When the standing column of drilling fluid is equal to or greater than the pressure at the depth of the borehole the conditions leading to a blowout are minimized. When the mud density is insufficient, the gases or fluids in the borehole can cause the mud to decrease in density and become so light that a blowout occurs.

Blowouts are a threat to drilling operations and a significant risk to both personnel and the environment. Typically blowout preventers or BOP's are installed at the ocean floor to minimize a blowout from an out-of-balance well. However, the primary method for minimizing blowout is the proper balancing of the drilling mud density to maintain the well in balance at all times. While BOP's can contain a blowout and minimize the damage to personnel and the environment, the well is usually lost once a blowout occurs, even if contained. It is far more efficient and desirable to use proper mud control techniques in order to reduce the risk of a blowout than it is to contain a blowout once it occurs.

In order to maintain a safe margin, the column of drilling mud in the annular space around the drill stem is of sufficient weight and density to produce a high enough pressure to limit risk to near zero in normal drilling conditions. While this is desirable it also slows the drilling process. In some cases underbalanced drilling has been attempted in order to increase the drilling rate. However, to the present day the mud density is the main component for maintaining a pressurized well under control.

Deep water and ultra deep water drilling has its own set of problems coupled to the need to provide a high density mud in a well bore that starts several thousand feet below sea level. The pressure at the beginning of the hole is equal to the hydrostatic pressure of the seawater above it, but the mud must travel from the sea surface to the sea floor before its density is useful. It is well recognized that it would be desirable to maintain mud density at or near seawater density (or 8.6 PPG) when above the borehole and at a heavier density from the seabed down into the well. In the past pumps have been employed near the seabed for pumping out the returning mud and cutting from the seabed above the BOP's and to the surface using a return line that is separate from the riser. This system is expensive to install, requiring separate lines, expensive to maintain and very expensive to run. Another experimental method employs the injection of low-density particles such as glass beads into the returning fluid in the riser above the sea floor to reduce the density of the returning mud as it is brought to the surface. Typically, the BOP stack is on the sea floor and the glass beads are injected above the BOP stack.

While it has been proven desirable to reduce the mud density above the sea floor there are not any prior art techniques that effectively accomplish this objective.

SUMMARY OF INVENTION

The subject invention is directed a method and apparatus for controlling drilling mud density above the sea floor, and when the BOP stack is on the seabed above the stack, of wells in deep water and ultra deep water applications. It is an important aspect of the invention that the mud is diluted using base fluid. The base fluid is of lesser density than the mud required at the wellhead and by combining the two a diluted mud results. In the preferred embodiment of the invention, the base fluid has a density less than seawater (or less than 8.6 PPG). By combining the appropriate quantities of drilling mud with base fluid, a riser mud density at or near the density of seawater may be achieved. It is an important feature of the invention that no additional hardware is required below the surface. The riser charging lines are used to inject the low-density base fluid at or near the BOP stack on the seabed. The cuttings are brought to the surface with the diluted mud and separated in the usual manner. The diluted mud is then passed through a centrifuge system to separate the heavier drilling mud from the lighter base fluid.

In the example where the desired riser mud density is 8.6 PPG, or that of seawater, it can be assumed the base fluid is an oil base having a density of approximately 6.5 PPG. Using an oil base mud system, for example, the mud may be pumped from the surface through the drill string and into the bottom of the well bore at a density of 12.5 PPG, typically at a rate of around 800 gallons per minute. The fluid in the riser, which is at this same density, is then diluted above the sea floor with an equal amount or more of base fluid through the riser charging lines. The base fluid is pumped at a faster rate, say 1500 gallons per minute, providing a return fluid with a density that can be calculated as follows:

$$(F_{Mi}\times Mi)+(F_{Mb}\times Mb)/(F_{Mi}+F_{Mb})==Mr,$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow above the sea floor in riser.

In the above example:

Mi=12.5 PPG,

Mb=6.5 PPG, $F_{Mi}$=800 gpm, and $F_{Mb}$=1500 gpm.

Thus, the density Mr of the return mud can be calculated as:

$$Mr=((800\times 12.5)+(1500\times 6.5))/(800+1500)=8.6\text{ PPG}.$$

The flow rate, $F_r$, of the mud having the density Mr in the riser is the combined flow rate of the two flows, $F_i$ and $F_b$. In the example, this is:

$$F_r=F_i+F_b=800\text{ gpm}+1500\text{ gpm}=2300\text{ gpm}.$$

The return flow in the riser above the BOP's is a mud having a density of 8.6 PPG (or the same as seawater) flowing at 2300 gpm. This mud is returned to the surface and the cuttings are separated in the usual manner. Centrifuges at the surface will then be employed to separate the heavy mud, density Mi, from the light mud, density Mb.

The system of the subject invention is particularly useful because it can be retrofitted on existing offshore rigs without requiring any additional hardware below the surface. The conduits and centrifuges required are all placed at the surface. The riser charging lines are employed to deliver the base fluid.

It is, therefore, an object and feature of the subject invention to provide a new and useful method and apparatus for diluting the mud density in the riser of a deep water or ultra deep water well.

It is another object and feature of the subject invention to provide a method and an apparatus for diluting mud density in a riser without adding any additional hardware to a riser system beneath the surface of a deep water or ultra deep water drilling installation.

It is an additional object and feature of the subject invention to provide a method and apparatus for diluting mud density in deep water and ultra deep water drilling applications for both drilling units and floating platform configurations. It is yet another object and feature of the subject invention to provide a method for diluting the density of mud in a riser by injecting low density fluids into the riser charging lines or riser systems with surface BOP's.

It is a further object and feature of the subject invention to provide an apparatus for separating the low density and high-density fluids from one another at the surface.

Other objects and features of the invention will be readily apparent from the accompanying drawing and detailed description of the preferred embodiment.

DESCRIPTION OF THE PREFERRED EMBODIMENT

Figure 1:
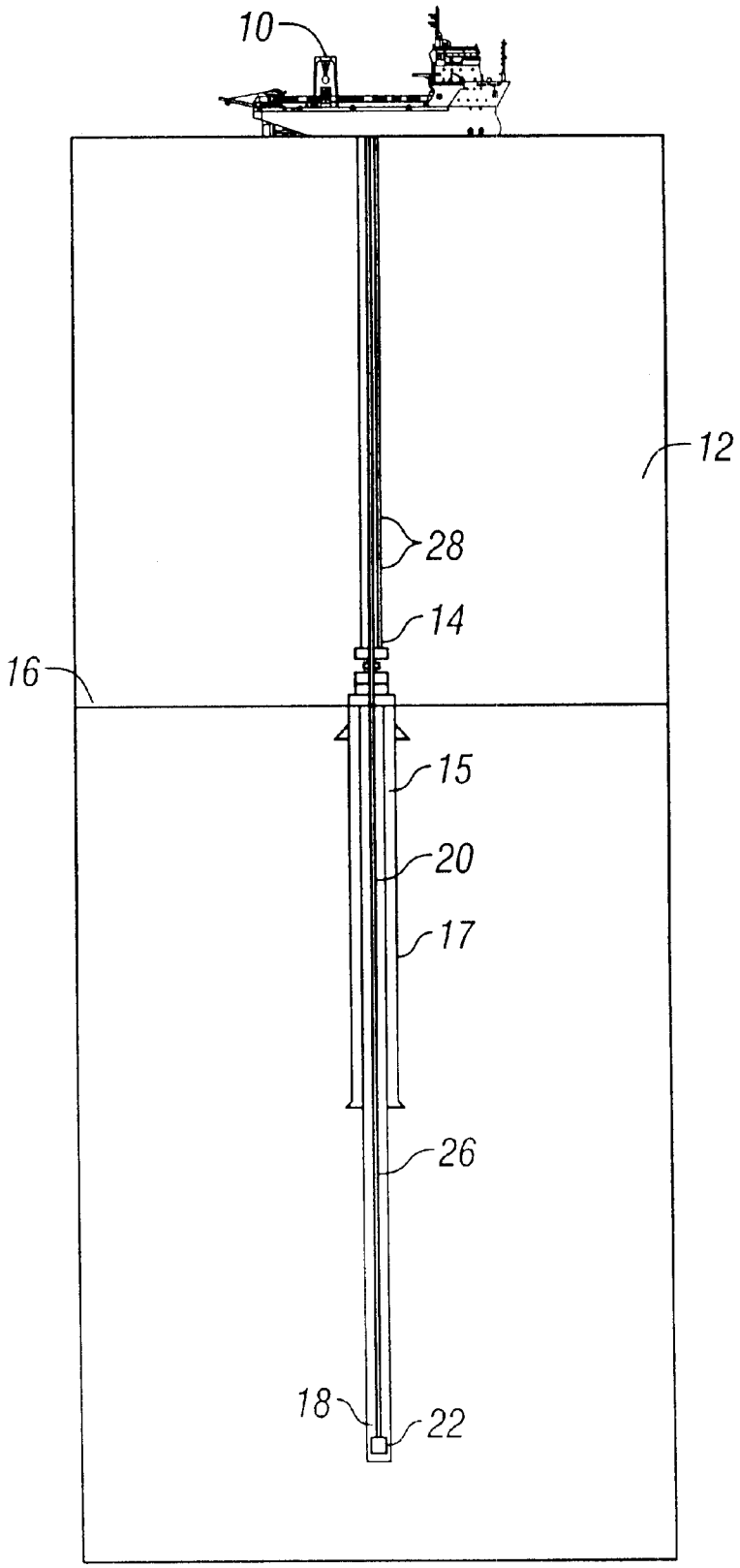
FIG. 1 is a schematic of a typical offshore drilling system modified to accommodate the teachings of the subject invention.
Figure 2:
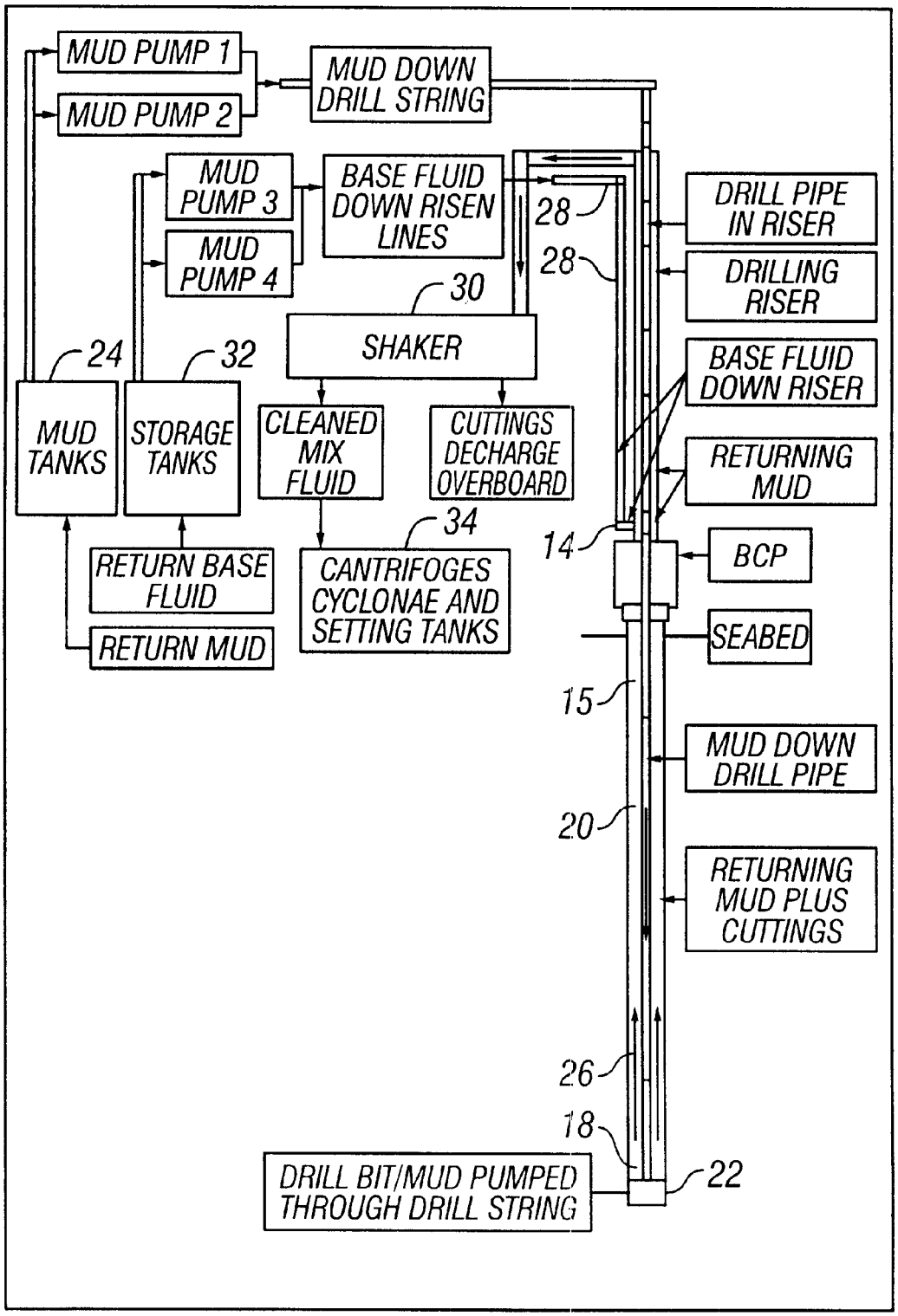
FIG. 2 is a diagram of the drilling mud circulating system in accordance with the present invention.

A typical offshore drilling system and mud recirculating system are shown in FIG. 1. The platform 10 may be an anchored floating platform or a drill ship or a semi-submersible drilling unit. A series of concentric strings run from the platform 10 to the sea floor or seabed 12 and into a stack 14. The stack 14 is positioned above the well bore 15 and includes a series of control components, generally including one or more blowout preventers or BOP's 16. The concentric strings comprise casing 17, tubing 18 and a drill string 20. A drill bit 22 is mounted on the end of the drill string. A mud management and flow system 24 is provided at the surface. In application, drilling mud is introduced into the tubing and is pumped down through the tubing and through the drill bit 22. As it flows out of the tubing 18 and past the drill bit, it flows into the annulus 26 around the tubing and defined by the outer wall of the tubing 18 and the inner wall of the casing 16. The mud picks up the cutting or particles loosed by the drill bit and carries them to the surface via the riser defined by the annulus between the tubing and casing. Riser charging lines 28 are provided for charging or pressurizing the fluid in the risers in the event a pressure differential develops that could impair the safety of the well. The rising mud and cuttings are separated at a typical separator such as the shaker system 30 and the mud is recycled into the well.

In the subject invention, a reservoir 32 contains a base fluid of lower density than the drilling mud and a mud pumps 3 and 4 connected to the riser charging lines. This base fluid is of a low enough density that when the proper ratio is mixed with the drilling mud a combined density equal to that of seawater can be achieved. The base fluid is pumped into the riser above the BOP stack (or above the sea floor if the stack is at the surface) and is combined with the drilling mud to reduce the density of the riser mud. The combined mud is separated at shaker system 30 to remove the cuttings and is then introduced into a centrifuge system 34 where the lighter base fluid is separated from the heavier drilling fluid. The lighter fluid is then recycled through reservoir 32 and the riser charging lines, and the heavier fluid is recycled in typical manner through the mud management and flow system and the drill string.

In a typical example the drilling mud is an oil based mud with a density of 12.5 PPG and the mud is pumped at a rate of 800 gpm. The base fluid is an oil base fluid with a density of 6.5 PPG and can be pumped into the riser charging lines at a rate of 1500 gpm. Using this example, a riser fluid having a density of 8.6 PPG is achieved as follows:

$$Mr=(F_{Mi}\times Mi)+(F_{Mb}\times Mb)/(F_{Mi}+F_{Mb}),$$

where:

$F_{Mi}$=flow rate $F_i$ of fluid into well, $F_{Mb}$=flow rate $F_b$ of base fluid into riser charging lines, Mi=mud density into well, Mb=mud density into riser charging lines, and Mr=mud density of return flow.

In the above example:

Mi=12.5 PPG,

Mb=6.5 PPG, $F_{Mi}$=800 gpm, and $F_{Mb}$=1500 gpm.

Thus, the density Mr of the return mud can be calculated as:

$$Mr=((800\times12.5)+(1500\times6.5))/(800+1500)=8.6\text{ PPG}.$$

The flow rate, $F_r$, of the mud having the density Mr in the riser is the combined flow rate of the two flows, $F_i$ and $F_b$. In the example, this is:

$$F_r=F_i+F_b=800\text{ gpm}+1500\text{ gpm}=2300\text{ gpm}.$$

Figure 3:
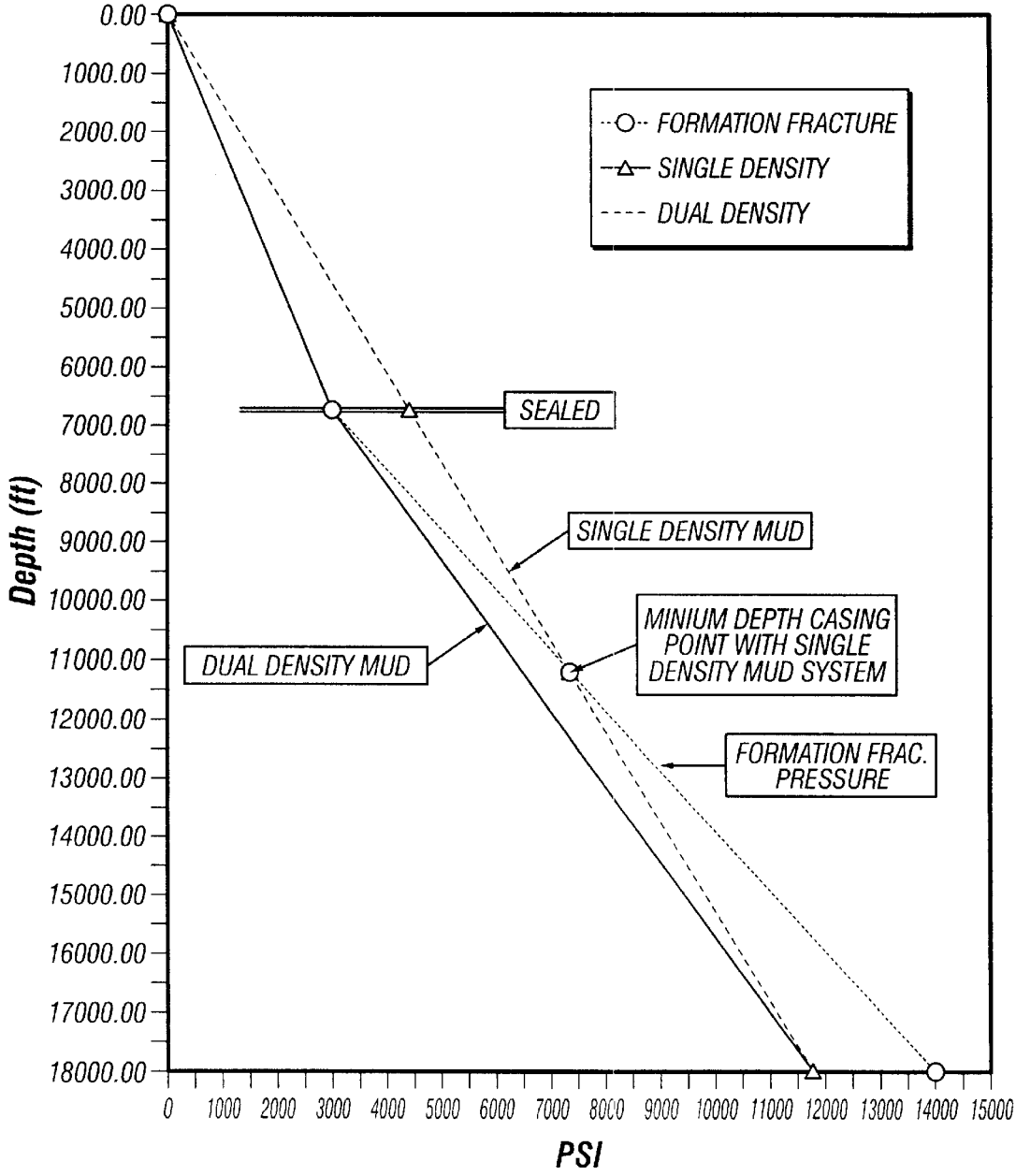
FIG. 3 is a graph showing depth versus down hole pressures and illustrates the advantages obtained using multiple density muds.

The return flow in the riser above the BOP's is a mud having a density of 8.6 PPG (or the same as seawater) flowing at 2300 gpm. This mud is returned to the surface and the cuttings are separated in the usual manner. Centrifuges at the surface will then be employed to separate the heavy mud, density Mi, from the light mud, density Mb.

Where desired, other density combinations may be utilized using the same formula. The subject invention is a useful method for varying the density of riser fluids without modifying subsurface hardware and therefore, is particularly useful in retrofit applications. An example of the advantages achieved using the dual density mud method of the subject invention is shown in the graph of FIG. 3. The vertical axis represents depth and shows the seabed or sea floor at approximately 6800 feet. The horizontal axis represents pressure in psi. The solid line represents dual density mud of the present invention. The dashed line represents formation frac pressure. The dashed line represents typical, single density mud of the prior art. In the example, the minimum depth casing point with single density mud is approximately 10,200 feet. Using the dual density mud of the subject invention, this depth is increased to 18,000 feet, while the mud pressure at the seabed is maintained at 3000 psi.

While certain features and embodiments have been described in detail herein, it should be understood that the invention includes all of the modifications and enhancements within the scope and spirit of the following claims.

What is claimed is:

1. A method employed at the surface for varying the density of fluid in a subsea riser of a drilling system comprising the steps of:

a. introducing at the surface a first fluid having a first density into a drill tube, such fluid being released from the drill tube and into the riser;

b. introducing at the surface a second fluid having a second density into the riser, for producing a combination fluid having a density that is defined by a selected ratio of the first fluid and the second fluid, such combination fluid rising to the surface; and c. separating the combination fluid after it has risen to the surface into the first fluid and the second fluid and storing same in separate storage units at the surface.

2. The method of claim 1, wherein there is a riser charging line associated with the subsea riser and the second fluid is introduced into the riser via the riser charging line.

3. The method of claim 1, wherein there is a blowout preventer system associated with the drilling system through which the drill tube and riser pass, the blowout preventer system being positioned at the seabed and wherein the second fluid is introduced into the riser above the blowout preventer system.

4. The method of claim 1, wherein the second density is lower than the first density.

5. The method of claim 4, wherein the second density is lower than the density of seawater and the first density is higher than the density of seawater.

6. The method of claim 5, wherein the second density is less than 8.6 PPG and the first density is greater than 8.6 PPG.

7. The method of claim 6, wherein the second density is 6.5 PPG and the first density is 12.5 PPG.

8. The method of claim 1, wherein the second density is lower than the density of seawater.

9. The method of claim 1, wherein the second density is lower than 8.6 PPG.

10. The method of claim 9, wherein the second density is 6.5 PPG.

11. The method of claim 1, wherein the first fluid is introduced into the drill tube at a first flow rate and the second fluid is introduced into the riser at a second flow rate.

12. The method of claim 11, wherein the first flow rate is slower than the second flow rate.

13. The method of claim 12, wherein the density of the combination fluid is determined by the combined densities of the first fluid and the second fluid and the first and second flow rates.

14. An apparatus for generating at the surface a riser fluid for use in a subsea well, said riser fluid having a density different from the drilling fluid, comprising:

a. a drilling platform;

b. a wellhead on the seabed;

c. a drilling string connecting the platform to the well and including a drillstem, drill tube and casing for defining the riser;

d. charging lines associated with the riser;

e. a source of drilling fluid on the platform, said drilling fluid of a first density for providing drilling fluid to be introduced into the drill tube; and f. a source of additional fluid on the platform, said additional fluid of a second density for providing said additional fluid to be introduced into the charging lines, whereby the first fluid and the second fluid are combined in the riser for producing a combined fluid having a density different from the density of the drilling fluid; and g. a separator on the platform for separating the combined fluid into its components as the combined fluid is discharged from the riser.

15. The apparatus of claim 14, wherein said first density is greater than said second density.

16. The apparatus of claim 14, further including a separator at the platform for separating the drilling fluid from the additional fluid.

17. The apparatus of claim 16, wherein the separator comprises a centrifuge system.

18. The apparatus of claim 14, further including a pump for pumping the drill fluid into the drill tube at a first rate of flow and a pump for pumping the additional fluid into the charging lines at a second rate of flow.

19. The apparatus of claim 18, wherein the first rate of flow is slower than the second rate of flow.

* * * * *